US011412794B2

(12) United States Patent
Schultz et al.

(10) Patent No.: US 11,412,794 B2
(45) Date of Patent: Aug. 16, 2022

(54) LIMB SLEEVES FOR BODY ALIGNMENT

(71) Applicants: William J. Schultz, Newport Beach, CA (US); Joanne Halbrecht, Boulder, CO (US)

(72) Inventors: William J. Schultz, Newport Beach, CA (US); Joanne Halbrecht, Boulder, CO (US)

(73) Assignee: AlignMed, Inc., Santa Ana, CA (US)

( * ) Notice: Subject to any disclaimer, the term of this patent is extended or adjusted under 35 U.S.C. 154(b) by 609 days.

(21) Appl. No.: 15/443,532

(22) Filed: Feb. 27, 2017

(65) Prior Publication Data

US 2017/0246068 A1 Aug. 31, 2017

Related U.S. Application Data

(60) Provisional application No. 62/301,334, filed on Feb. 29, 2016.

(51) Int. Cl.

| | |
|---|---|
| ***A41D 27/10*** | (2006.01) |
| ***A41D 13/05*** | (2006.01) |
| ***A41D 13/08*** | (2006.01) |

(52) U.S. Cl.

CPC ..... *A41D 27/10* (2013.01); *A41D 13/0543* (2013.01); *A41D 13/0562* (2013.01); *A41D 13/08* (2013.01); *A41D 2400/32* (2013.01)

(58) Field of Classification Search

CPC ..... A41D 13/0015; A41D 27/10; A41D 2400/38; A41D 1/007; A41D 13/0543; A41D 13/08; A61F 5/01; A61F 5/0102; A61F 5/0104; A61F 5/0109; A61F 5/0118; A61F 5/3723; A61F 2013/0028; A61F 13/061; A61F 13/062; A61F 13/085; A61F 13/10; A61F 13/101; A61F 13/102; A61F 13/107; A61F 2/00; A61F 2/64; A61F 2/582; A61F 2/6607; A61F 2007/0042; A61F 2007/0039; A61F 2007/0001; A61F 2007/0032; A61F 2007/0044;

(Continued)

(56) References Cited

U.S. PATENT DOCUMENTS 3,046,981 A * 7/1962 Biggs, Jr. ..... A61F 5/0109 602/26
3,088,115 A * 5/1963 Groot ..... A63B 71/12 2/462

(Continued)

OTHER PUBLICATIONS https://web.archive.org/web/20130905001311/http://store.cranbarry.com/cranbarry-arm-guards-only-p378.aspx (Year: 2013).*

*Primary Examiner* — Samchuan C Yao
*Assistant Examiner* — Nathan M Le
(74) *Attorney, Agent, or Firm* — ArentFox Schiff LLP

(57) ABSTRACT

A sleeve for wear on a body limb includes a sleeve body and a strap body. The strap body includes straps with fasteners at or near the ends of the straps for attachment to the sleeve body. An arm sleeve includes a thumb opening connected to a tension strap that extends along the length of the sleeve. The arm sleeve is configured to apply a twisting force when the opening is placed on the thumb. An arm and shoulder sleeve includes a lower sleeve, and upper arm cover and straps extending from an elbow band to extend from the upper arm cover for attachment to another garment.

2 Claims, 11 Drawing Sheets

(58) Field of Classification Search
CPC ..... A61F 2007/004; A63B 2071/1208; A61H 19/0078; A61H 9/0092; A61H 7/002; A61H 2201/1652; A61H 11/00
USPC ..... 2/22, 59
See application file for complete search history.

(56) References Cited

U.S. PATENT DOCUMENTS 3,934,583 A * 1/1976 Hollingshead ..... A61F 5/0585 602/62
4,366,813 A * 1/1983 Nelson ..... A61F 5/0109 2/24
5,154,690 A * 10/1992 Shiono ..... A61F 5/0102 602/21
5,556,374 A * 9/1996 Grace ..... A61F 5/0109 602/20
D635,267 S * 3/2011 Chiang ..... D24/190
9,017,274 B2 * 4/2015 Forbes ..... A61F 5/0109 602/26
9,314,364 B2 * 4/2016 Nelson ..... A61F 5/0106
2007/0179421 A1 * 8/2007 Farrow ..... A61H 1/008 602/75
2008/0235846 A1 * 10/2008 Schossberger ..... A41D 13/088 2/59
2010/0210985 A1 * 8/2010 Kuorak ..... A61F 5/3723 602/20
2012/0109031 A1 * 5/2012 Vollbrecht ..... A61F 13/062 602/5
2013/0092179 A1 * 4/2013 Reinhardt ..... A61F 5/3738 128/878
2013/0104280 A1 * 5/2013 Boynton ..... A61F 5/0104 2/79
2013/0281903 A1 * 10/2013 Kozasa ..... D04B 1/26 602/23
2014/0194801 A1 * 7/2014 Thorsteinsdottir ... A61F 5/0123 602/26

* cited by examiner

FIG. 19
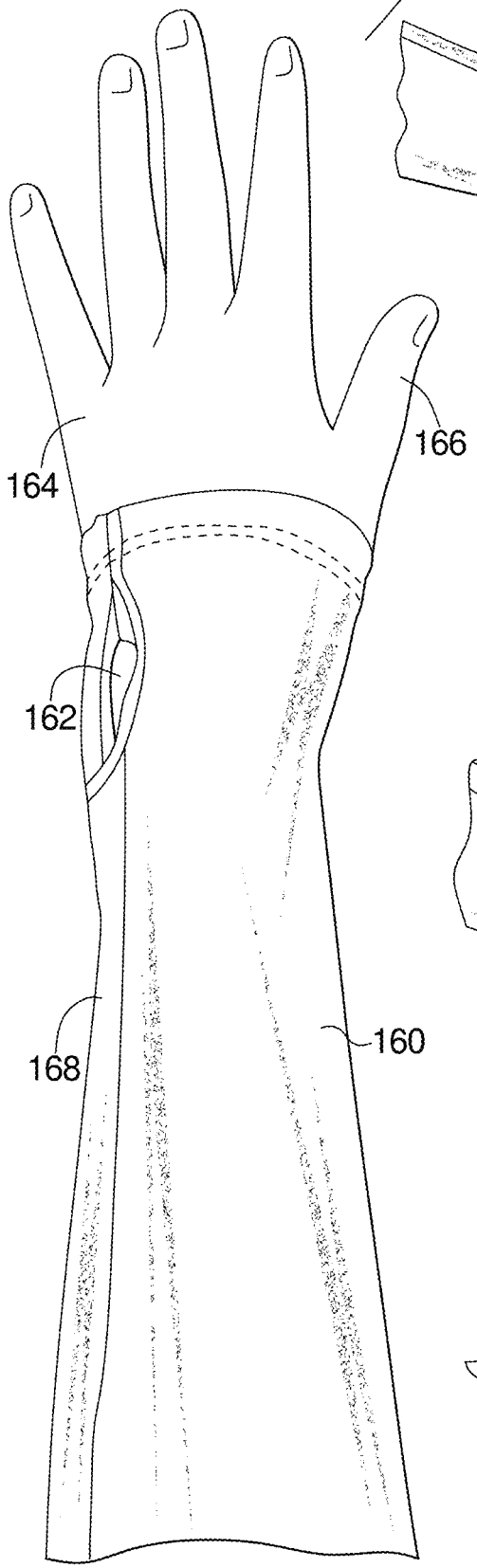
FIG. 20
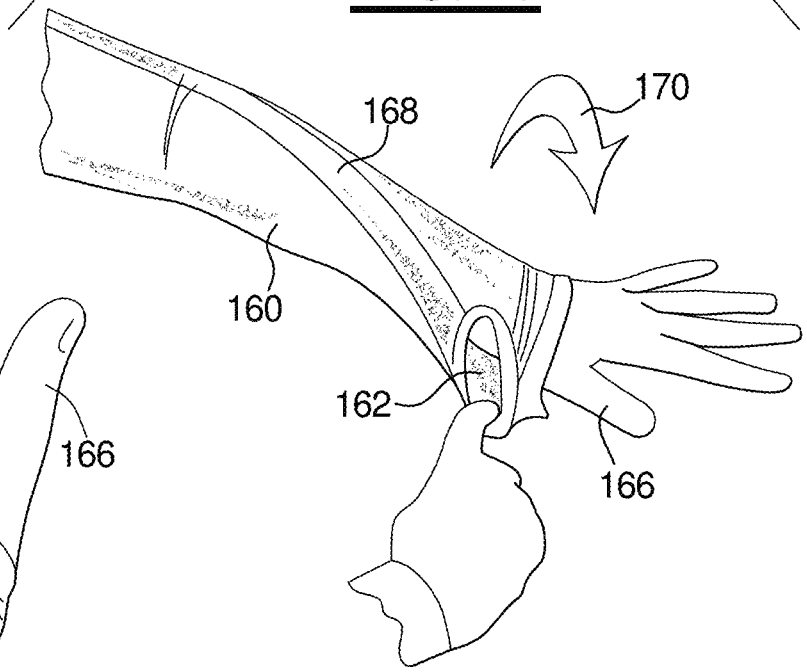
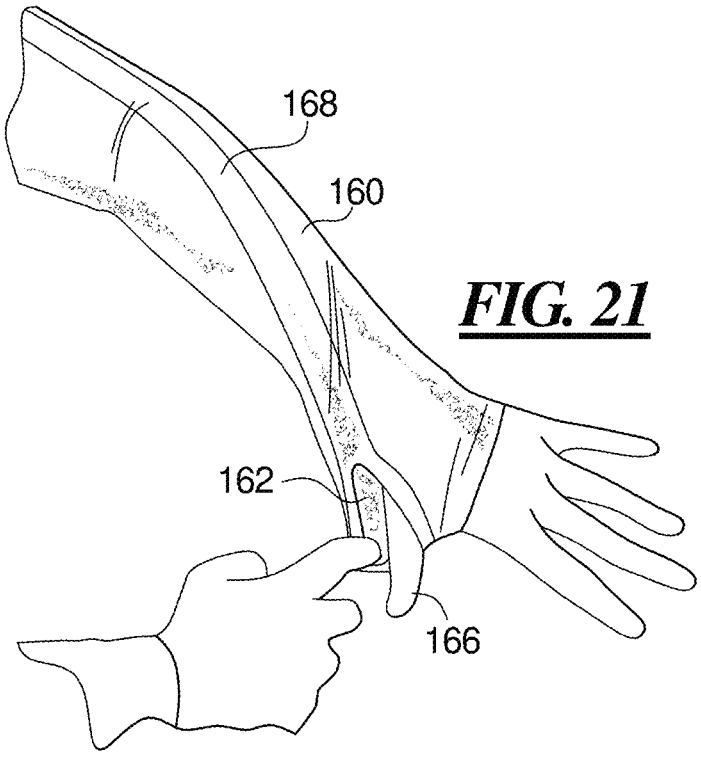
FIG. 21

BEFORE

AFTER

LIMB SLEEVES FOR BODY ALIGNMENT

CROSS REFERENCE TO RELATED APPLICATION

The present invention claims the benefit of U.S. Provisional Patent Application Ser. No. 62/301,334, filed Feb. 29, 2016, which is incorporated herein by reference.

BACKGROUND OF THE INVENTION

Field of the Invention

The present invention relates generally to a garment for wear on a limb of a body, and more particularly to a sleeve for a person to wear on an arm or leg.

Description of the Related Art

Garments are worn by persons for different purposes including for warmth or protection, for modesty, for bodily decoration or fashion, for absorbing perspiration, or for other purposes. Some garments are worn for stimulating part of the body or for having a therapeutic or beneficial effect on the body. An example is a garment to aid in improving posture or for aiding or guiding movement.

SUMMARY OF THE INVENTION

The present invention provides a garment such as a sleeve for wear on an arm or leg of a person. The sleeve of certain embodiments provides compression in an oblique direction and torque and resistance in one or more predetermined directions. The sleeve may include built-in components to provide compression, torque or resistance. The sleeve may include external components to provide compression, torque or resistance. The external components may be permanently affixed to or positioned on the sleeve or may be removable or repositionable on the sleeve.

BRIEF DESCRIPTION OF THE DRAWINGS

FIG. 19 is an arm sleeve shown on a wearer's arm;

FIGS. 20 and 21 are steps in applying a twisting tension to the sleeve while on the wearer's arm;

DETAILED DESCRIPTION OF THE PREFERRED EMBODIMENTS

Figure 1:
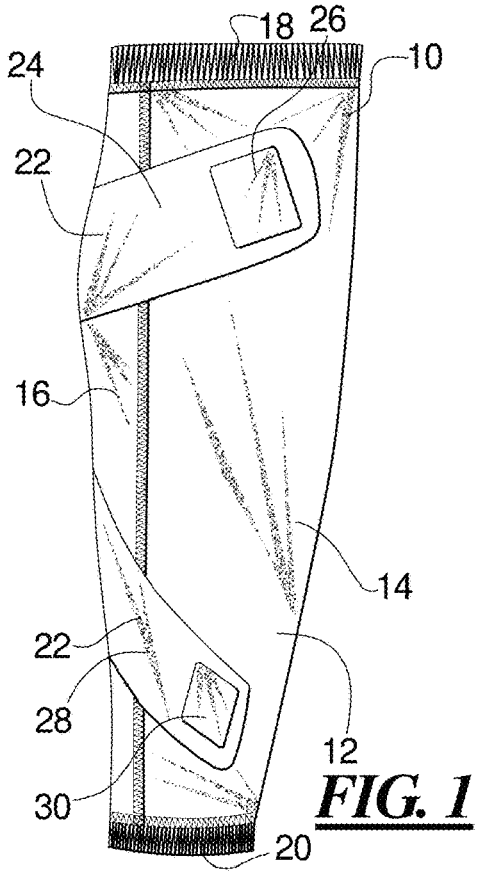
FIG. 1 is a left side view of a sleeve garment being worn by a wearer.

The present invention relates generally to an article of clothing worn on the arms and legs that applies oblique compression, torque and resistance to improve alignment and increase blood flow.

External sleeves worn to improve the anatomical neutral position of the body and influence the body's relationship with gravitational forces.

The present invention provides many different embodiments of a modular compression and alignment garment and method of assembly. The following summary also provides various examples of elastomeric materials, compression, receptivity and so forth.

Certain embodiments of the present invention provide a sleeve garment with a twist function and/or tension straps that are specifically adapted to provide neuromuscular stimulation using a combination of oblique compression, torque and angle simultaneously applied in order to train body muscles for proper alignment through muscle memory.

In some embodiments, receptivity is used with tension straps that provide active oblique compression and cause muscles to contract in a desired direction. Receptivity also allows attachments and connectivity to other areas of the body.

The garment provides a plurality of bands with elastomeric properties in the range of 15%-100%. Each tension band is designed to provide a predetermined level of stimulation, oblique compression and torque at maximal stretch.

The garment utilizes bands engineered in different shapes, sizes and stretch. A variety of applications can be used on different body parts to cause muscle contractions is the desired direction of the inventor. Therefore, the garment can be specifically engineered to have the desired range of pressure, oblique compression and torque.

In another embodiment, a garment is provided where all oblique compression, torque and resistance is built-into the garment.

The garment utilizes a "twist" function. The garment is constructed with gradient sequential levels of elastomeric knits positioned on the limbs in a specific kinetic direction. A higher gradient of knit is constructed into the garment using muscle mapping. When the sleeve is twisted by the user the garment increases oblique compression and starts to reposition limb. The optimum tightness in accordance with the body shape is obtained propelling the limb to anatomical neutral.

The higher gradient of knit area consists of a composition layer of plastomeric or elastomeric material such as silicone, latex etc. This enables traction on the surface area to influence twist movement.

The garment may provide medical, orthopedic and/or neurological benefits. In addition, it may provide therapy for improving alignment, cardiovascular, symmetry and visceral functions of a user. The user may be a patient who may be treated for medical and/or psychological ailments using the garment. The present application discloses processes and devices and a system to improve the physical and psychological health of the user.

The motion transfer may be by straps and/or by portions of the sleeves. For example, panels and/or straps of the garment having particular tension transfer characteristics, elasticity, resistance to stretching or other characteristic may be used for the motion transfer. The panels and/or straps may have directional tension and/or motion transfer so that greater motion is transferred in one direction than another, for example. The panels, straps or other garment portions may have textures, surface features, grip elements, slip elements, sleeves, channels, layers, or other features that cause some portions to garment to grip or stimulation areas of the user's body and that may permit the motion to be transferred over other areas of the user's body with less stimulation or grip.

Provides gradual compression in accordance with the shape of leg by the tensile force exerted by the knit in a vertical plane.

Referring to the drawings, in FIG. 1, a sleeve 10 includes a sleeve body 12. The sleeve body 12 includes first panel 14 and a second panel 16. The first and second panels 14 and 16 are of fabrics that have mutually different characteristics. For example, the panels 14 and 16 may have directional elastic characteristics, or may have tension or compression characteristics. The panels 14 and 16 may be formed of layers of fabric with more or fewer layers at each panel. One or both panels 14 and 16 may be formed of Velcro-receptive material. The sleeve body 12 has an upper cuff 18 and a lower cuff 20. The cuffs 18 and 20 may be of elastic material or may include elastic material. The cuffs 18 and 20 may include an inside layer of a grippy or rubberized material that exert a grip on the skin and tissues of the wearer.

On the sleeve 10 is a strap unit 22. The strap unit 22 includes a shorter strap 24 that has a fastener 26 at or near its free end. The fastener 26 of certain embodiments is a Velcro fastener that is fastenable to the Velcro-receptive fabric of the panel 14. The strap unit 22 has a longer strap 28 that also includes a fastener 30 at or near its free end. The shorter strap 24 is angled upwardly and fastened near the upper part of the sleeve 12 and the upper part of the limb of the wearer. The longer strap 28 is angled downwardly and fastened near the lower part of the sleeve 12 and lower portion of the limb of the wearer. The straps 24 and 28 wrap around the sleeve 12 and wearer's limb. Tension is applied by the straps when the straps are applied to the sleeve 12 while worn, for example, tension along the direction of the straps.

Figure 2:
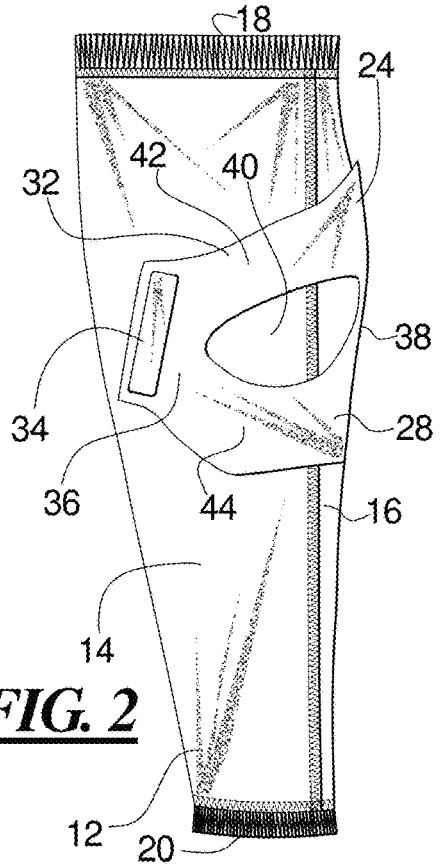
FIG. 2 is a right side view of the sleeve of FIG. 1.

In FIG. 2, the sleeve 12 has the panels 14 and 16. The shorter strap 24 and the longer strap 28 are joined to one another in a central portion 32, shown in FIG. 2. The central portion 32 has a fastener 34 at or near its free end. The central portion 32 includes a first connecting portion 36 and a second connecting portion 38. The connecting portions 36 and 38 extend between the shorter strap 24 and the longer strap 28 and define an opening 40. Adjacent end portions 42 and 44 of the shorter strap 24 and longer strap 28 complete the structure surrounding the opening 40. The opening 40, adjacent end portions 42 and 44 and the second connecting portion 38 extend over the panel 16.

Compression is applied to the limb of the wearer by the sleeve 10 as a whole. Selective tension or compression is supplied by the panels 14 and 16. Additional, directional tension and compression and stimulation are applied by the straps of the strap unit 22. The strap unit 22 is removable and adjustable by the user to permit adjustment of the tension and compression applied by the strap unit 22.

FIGS. 1 and 2 show the sleeve 10 for wear on a limb of a human body or other animal body. A mirror image of the sleeve 10 may be provided for the corresponding other limb. For example, the sleeve may be provided for a calf portion of the wearer's leg and a mirror image sleeve may be provided for the wearer's other leg. The sleeve 10 may be worn on the wearer's arm, such as on the forearm of the person, with a mirror image sleeve for the other arm.

Figure 3:
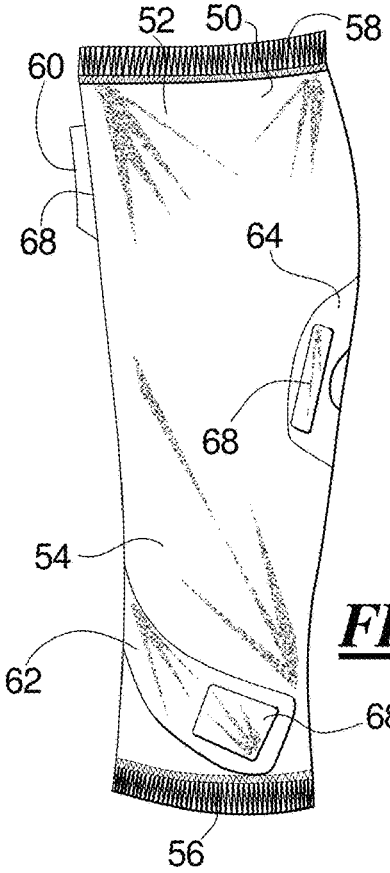
FIG. 3 is a left side view of a second embodiment of a sleeve garment being worn by a wearer.

In FIG. 3 is shown a second embodiment of a sleeve 50. The sleeve 50 has a sleeve body 52 that includes a panel 54 and cuffs 56 and 58. On the panel 54 is attached a shorter strap 60, a longer strap 62 and a central portion 64 of a strap unit 66. The shorter strap 60, longer strap 62, and central portion 64 include fasteners 68 by which the straps and central portion are attached to the panel 54.

Figure 4:
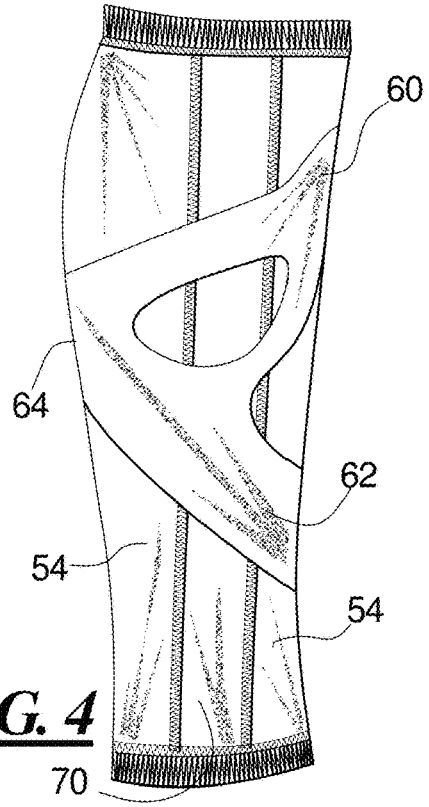
FIG. 4 is a right side view of the sleeve of FIG. 3.

FIG. 4 shows the other side of the sleeve 50. The panel 54 is joined to a second panel 70 which extends the length of the sleeve 50. The panel 70 may be of a different fabric or more or fewer layers of a same or different fabric.

Figure 5:
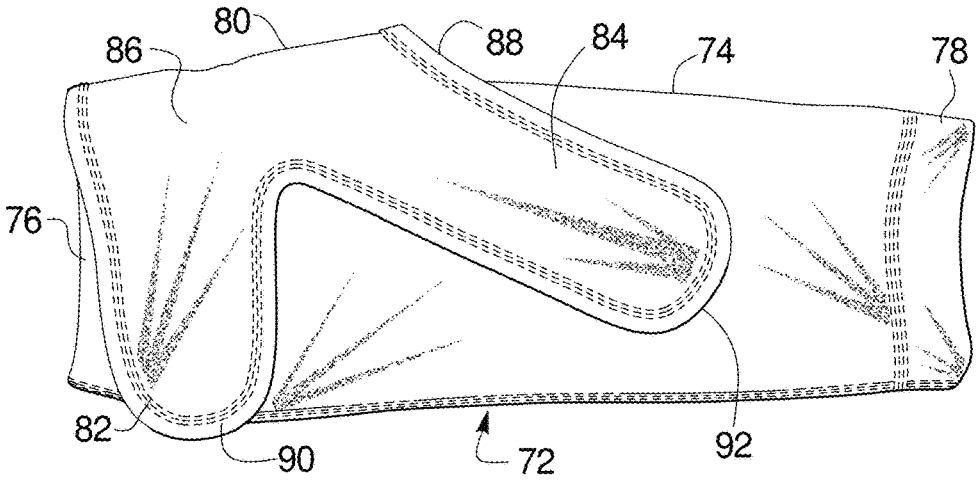
FIG. 5 is a top view of a sleeve for wear on a wearer's calf.

FIG. 5 shows a sleeve 72 configured for wear on a user's lower leg. The sleeve 72 includes a sleeve body 74 of a stretchable fabric such as a stretchable ribbed fabric having a mesh-like outer surface. The sleeve body 74 includes an upper cuff 76 and a lower cuff 78. Attached to the sleeve body 74 is a strap member 80 having two straps 82 and 84 disposed at an angle to one another. The strap member 80 includes a shorter upper strap 82 that is disposed generally horizontally and adjacent to the upper cuff 76. The strap member 80 also includes a longer lower strap 84 disposed at an angle to the shorter upper strap 82. The upper and lower straps 82 and 84 connect to one another at a connecting portion 86.

The strap member 80 is formed of a heavy fabric that is resistant to stretching, such as neoprene or other fabric. A hem 88 of a second fabric is sewn onto the heavy fabric to enclose the edge of the heavy fabric. The heavy fabric of the strap member 80 may be textured with a suede texture on its outer surface. The edging fabric of the hem 88 may have a satiny texture. The free ends 90 and 92 of the straps 82 and 84 are provided with Velcro fasteners or other fasteners and the sleeve body 74 is provided with a Velcro-receptive surface. The ends 90 and 92 of the straps 82 and 84 are attached to the sleeve body 74 by the Velcro fasteners or other fasteners. The straps 82 and 84 exert additional and directions compression and tension on the wearer's limb when worn.

Figure 6:
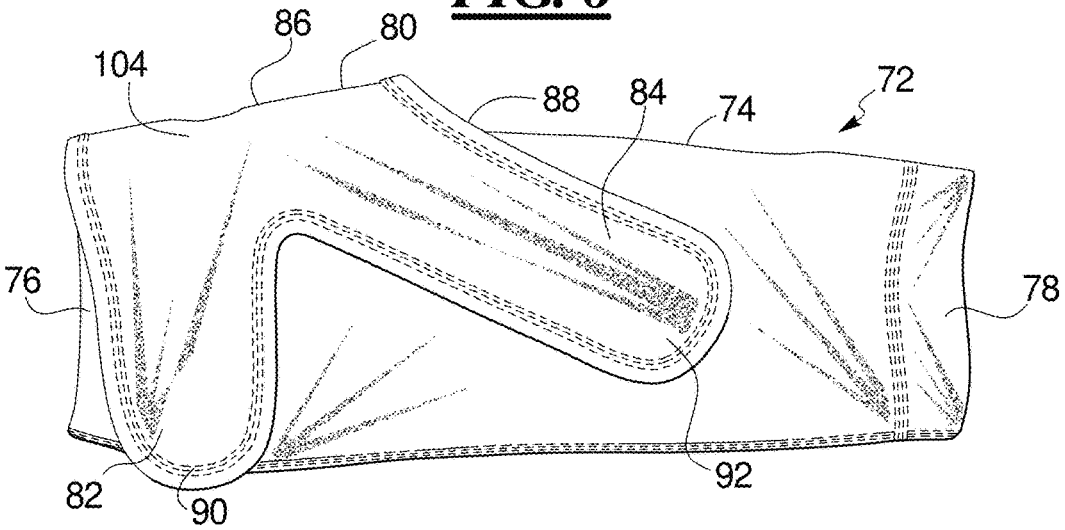
FIG. 6 is a top view of the sleeve of FIG. 5.
Figure 7:
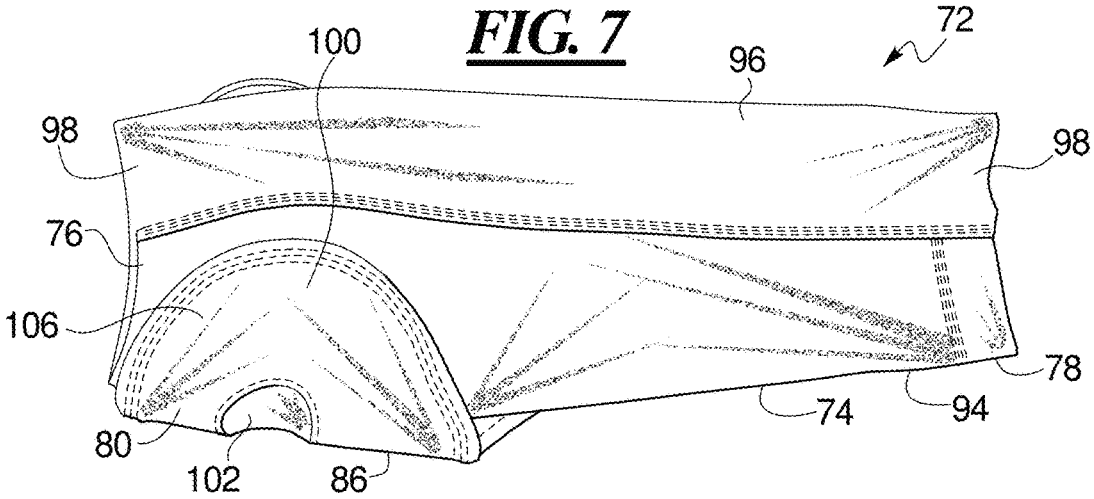
FIG. 7 is a bottom view of the sleeve of FIG. 5.

FIGS. 6 and 7 provide a comparison of the front and back of an embodiment of the sleeve 72 of FIG. 5. In the front view of FIG. 6, the ribbed fabric of the sleeve body 74 is a ribbed fabric panel 94 that is connected to a second fabric panel 96 to complete the sleeve body 74. In the rear view of FIG. 7, the second fabric panel 96 of the illustrated embodiment is of a contrasting color and pattern compared to the ribbed fabric panel 94. For example, the ribbed fabric panel 94 of the illustrated example is of heavy fabric that is resistant to stretching and that has a Velcro-receptive outer surface. The panel 94 is referred to as ribbed in this disclosure but alternative embodiments may be formed of a non-ribbed fabric. The second fabric panel 96 may be of a lighter, thinner fabric which is more stretchable (with greater stretching characteristics), such as of Lycra or a similar fabric. The upper and lower cuffs 76 and 78 that are provided on the ribbed fabric panel 94 as additional cuff materials, are not provided on the second fabric panel 96. Instead, the second fabric panel 96 includes a hem 98 at either end. The second fabric panel 96 forms a strip that extends the length of the sleeve body 74. The second fabric panel 96 of certain embodiments is not Velcro receptive or at least not as receptive to Velcro fastening as the ribbed fabric panel 94.

The strap member 80 has the connecting portion 86 extending on to the rear side of the sleeve 72 and attached there by a Velcro fastener at an end 100. The connecting portion 86 defines an opening 102 between the shorter strap 82 and the longer strap 84 and between a first connecting link 104 (visible in FIG. 6) of the connecting portion 86 and a second connection link 106 (visible in FIG. 7) of the connecting portion 86. The strap member 80 is removable and repositionable on the sleeve body 74 to provide tension on the limb of the wearer in the direction of the two straps 82 and 84.

Figure 8:
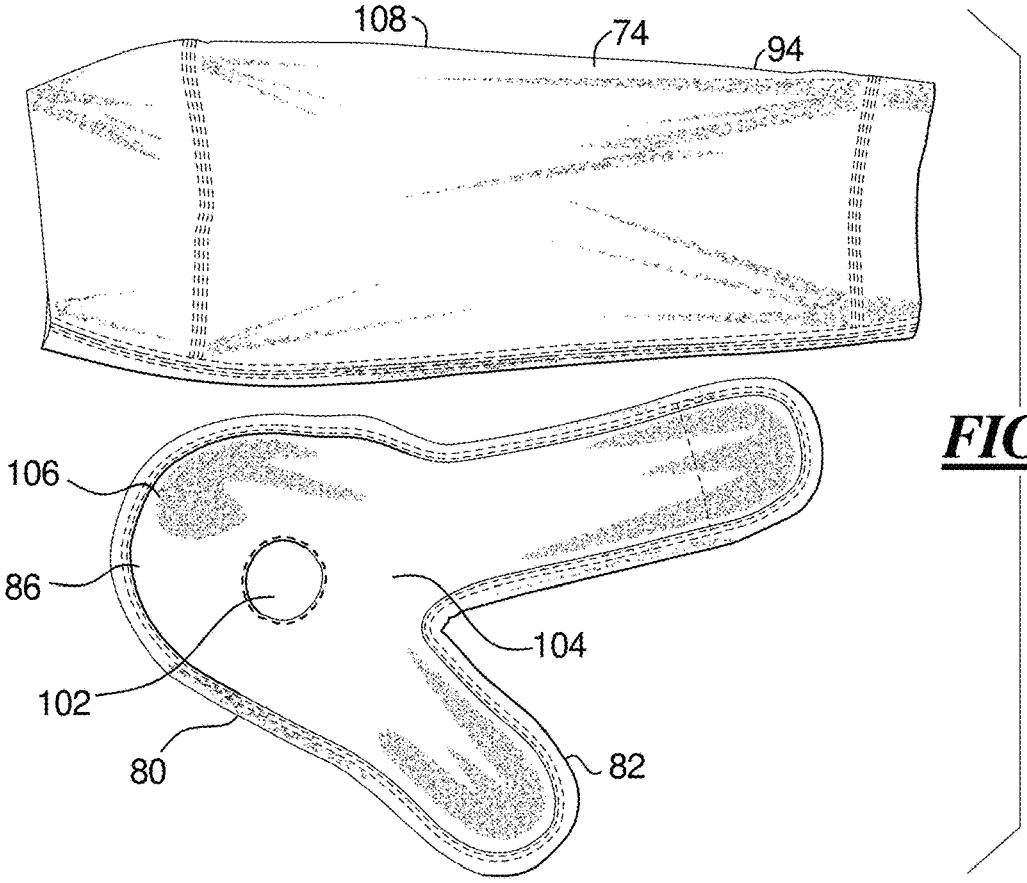
FIG. 8 is a top view of the sleeve of FIG. 5 showing the straps removed and alongside the sleeve.

FIG. 8 shows a front view 108 of the sleeve body 74 and the strap member 80 separated from one another. The sleeve body 74 is shown with the ribbed fabric panel 94 facing the viewer. The strap member 80 includes the short strap 82 and the long strap 84 connected to the connecting portion 86 at an angle to one another. The connecting portion 86 is generally toroidal in shape with the opening 102 near the center of the connecting portion 86. The first connecting link 104 and the second connecting link 106 surround the opening 102.

Figure 9:
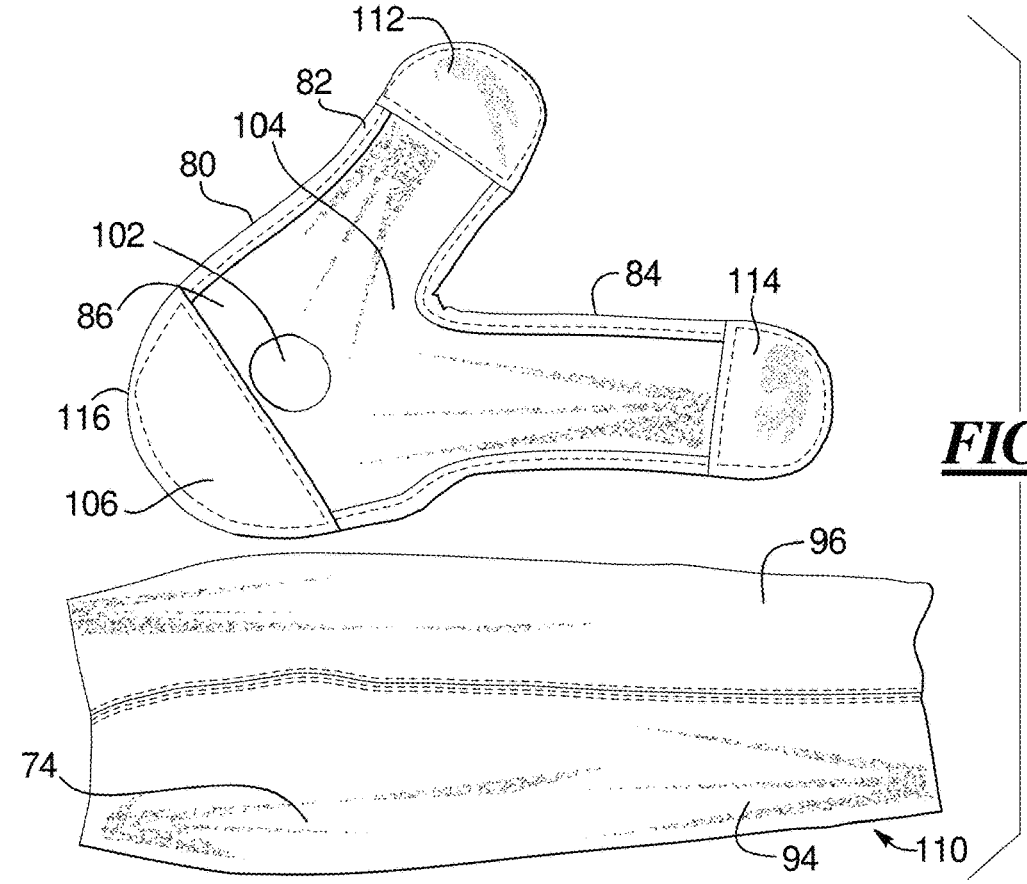
FIG. 9 is a bottom view of the sleeve and straps of FIG. 8.

FIG. 9 shows the embodiment of FIG. 8 from a back view 110. The sleeve body 74 has the ribbed fabric panel 94 extending over about one half of the back side 110. The second fabric panel 96 extends over approximately the other half of the back side 110. The sleeve body 74 is configured to fit snuggly on a lower leg of a wearer, for example, extending from approximately the knee or just below the knee to the ankle or just above the ankle. Shorter or longer sleeve bodies may be provided as desired. The sleeve body 74 tapers from a wider portion near the top to a narrower end near the bottom. The top end is tapered inward to engage the top of the calf muscles.

The strap member 80 includes Velcro or other fastener portions 112 and 114, sewn onto the ends of the short and long straps 82 and 84 and the faster portion 116 on an outermost portion of the connecting portion 86, for example at the second connecting portion 106. The strap member 80 is free of fastening portions other than at the strap ends and the connecting portion end. The fasteners on the strap member permit the tension to be applied along two directions about the wearer's leg.

Figure 10:
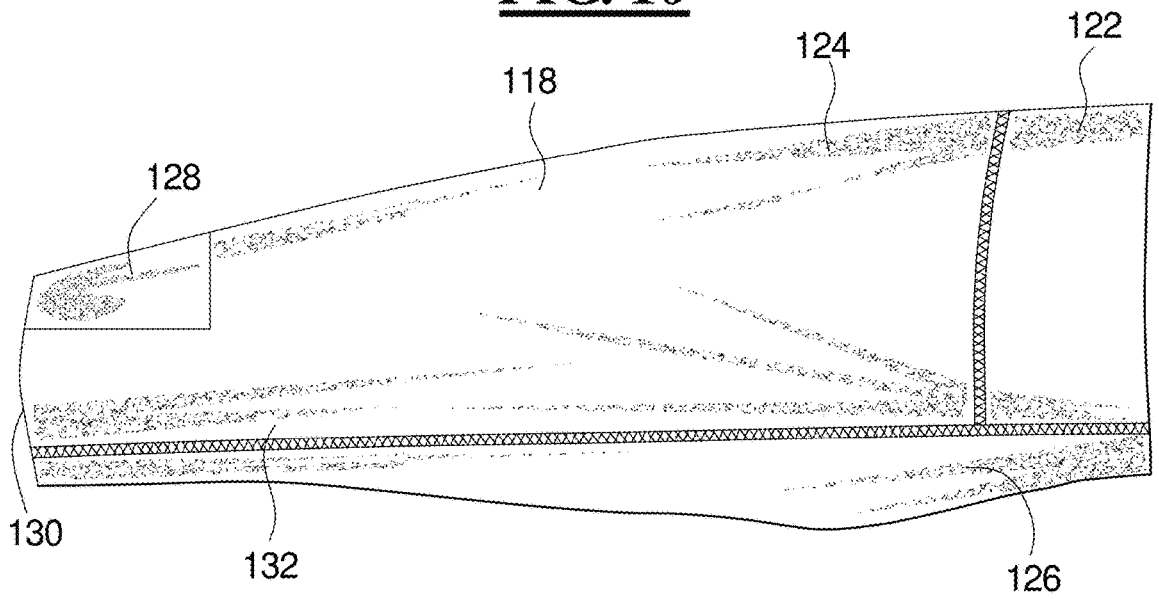
FIGS. 10 and 11 are front views of right and left sleeves for wear on a wearer's lower leg, showing the position when worn.
Figure 11:
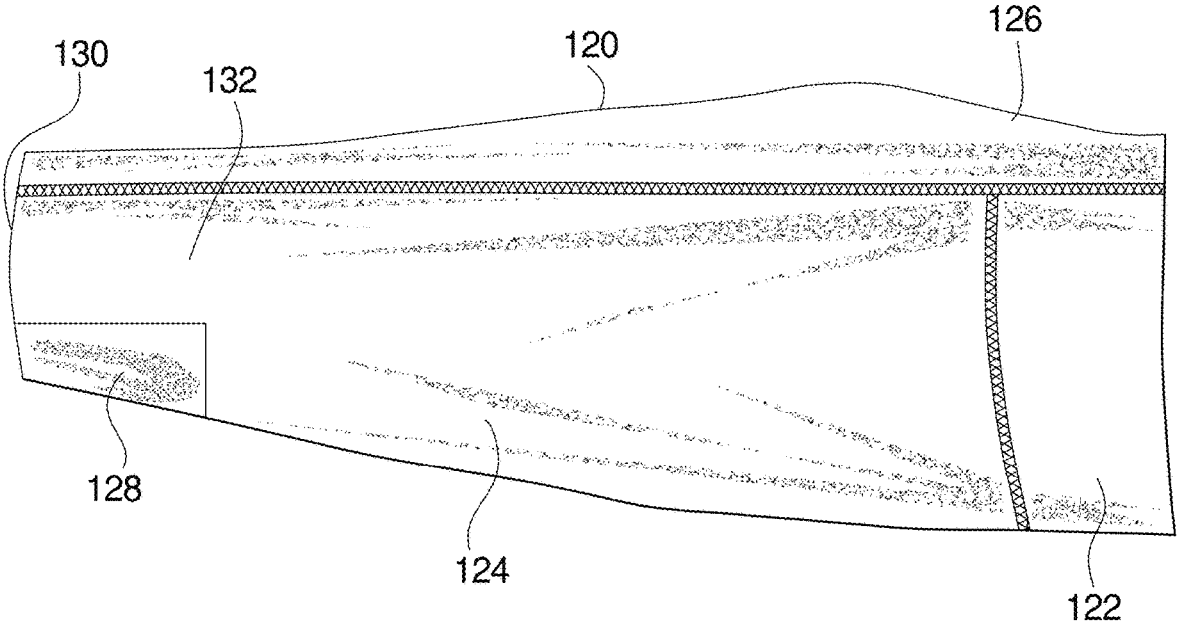

FIGS. 10 and 11 show mirror image constructed sleeves 118 and 120 for wear on the right and left lower legs of a wearer. In the illustrated embodiment a wide top cuff 122 is provided at the top of each sleeve. The wide top cuff 122 extends part way around each sleeve 118 and 120 to the same extent as a ribbed or textured fabric panel 124 but does not extend at the second fabric panel 126 that forms a strip along the length of the sleeves 118 and 120. A lower cuff portion 128 extends a smaller distance around each sleeve 118 and 120 at a lower end of the respective sleeve. The ribbed or textured fabric panel 124 extends to a lower hem 130 of each sleeve 118 and 120 at a portion 132 adjacent to the lower cuff. The second fabric panel 126 is disposed for wear over the inner surface of the wearer's calf so that the second fabric strips face each other when worn. The fabric panels 124 and 126 as well as the cuffs 122 and 128 are of different fabrics having different stretch characteristics and different textures to provide compression, tension, stimulation to the wearer's legs in controlled ways.

Figure 12:
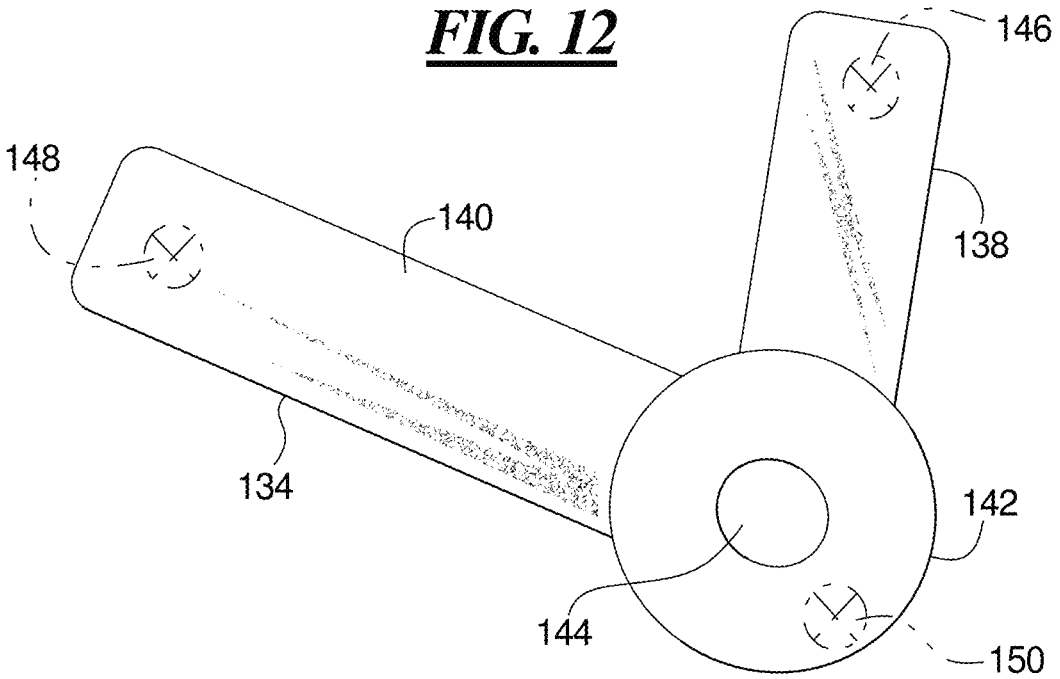
FIGS. 12 and 13 are front views of right and left strap members for attachment to the sleeves of FIGS. 10 and 11.
Figure 13:
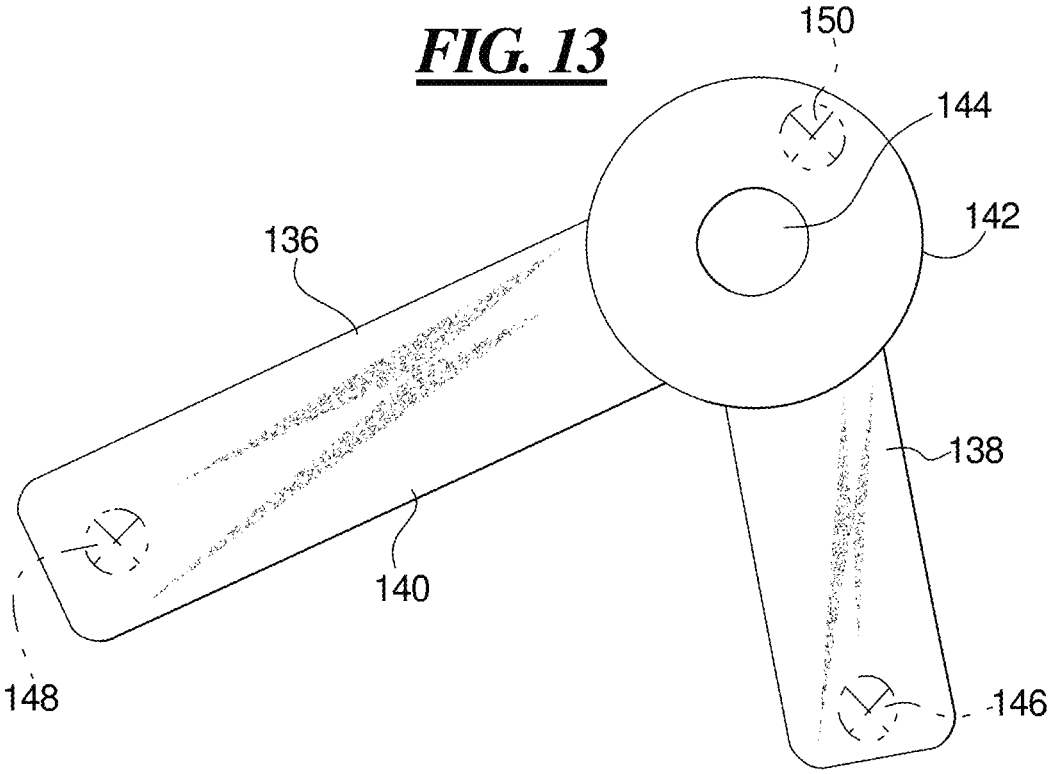

FIGS. 12 and 13 show the mirror image structures of strap members 134 and 136 for wear on the wearer's right and left lower legs. The strap members 134 and 136 are shown in the positions that they would be applied to the sleeves, for example the sleeves 118 and 120. The strap members 134 and 136 have short straps 138 that extend outward away from one another and upward at a shallow angle. Long straps 140 extend downward away from one another at a steeper angle, the steeper angle at which the straps are worn in certain embodiments. Each strap member 134 and 136 has a connecting portion 142 that is toroidal in shape with a central opening 144. The connecting portions 142 are disposed toward one another. Fasteners 146 and 148 are provided at the ends of the straps 138 and 140, respectively, and a fastener 150 is provided at the connecting portion 142. The fasteners are configured for fastening to the sleeve bodies and may include Velcro or other fasteners. The arrangement shown is an example of the position of the strap members when applied to the sleeves.

Figure 14:
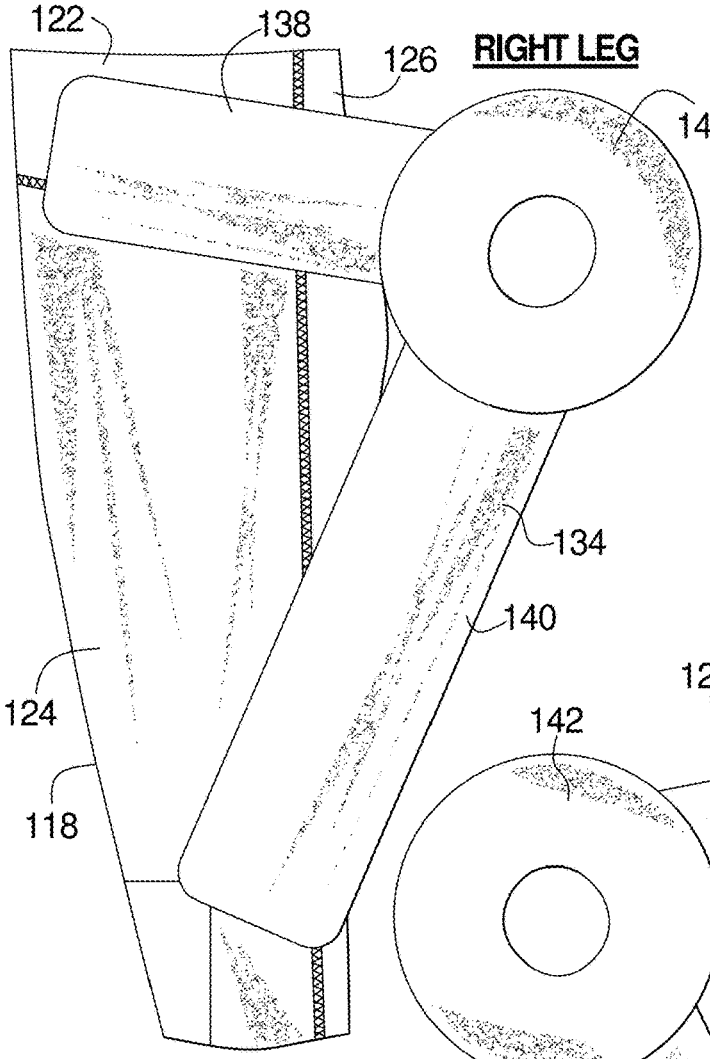
FIGS. 14 and 15 are front views of the strap members being applied to the sleeves while on the wearer's legs, starting at the strap ends.
Figure 15:
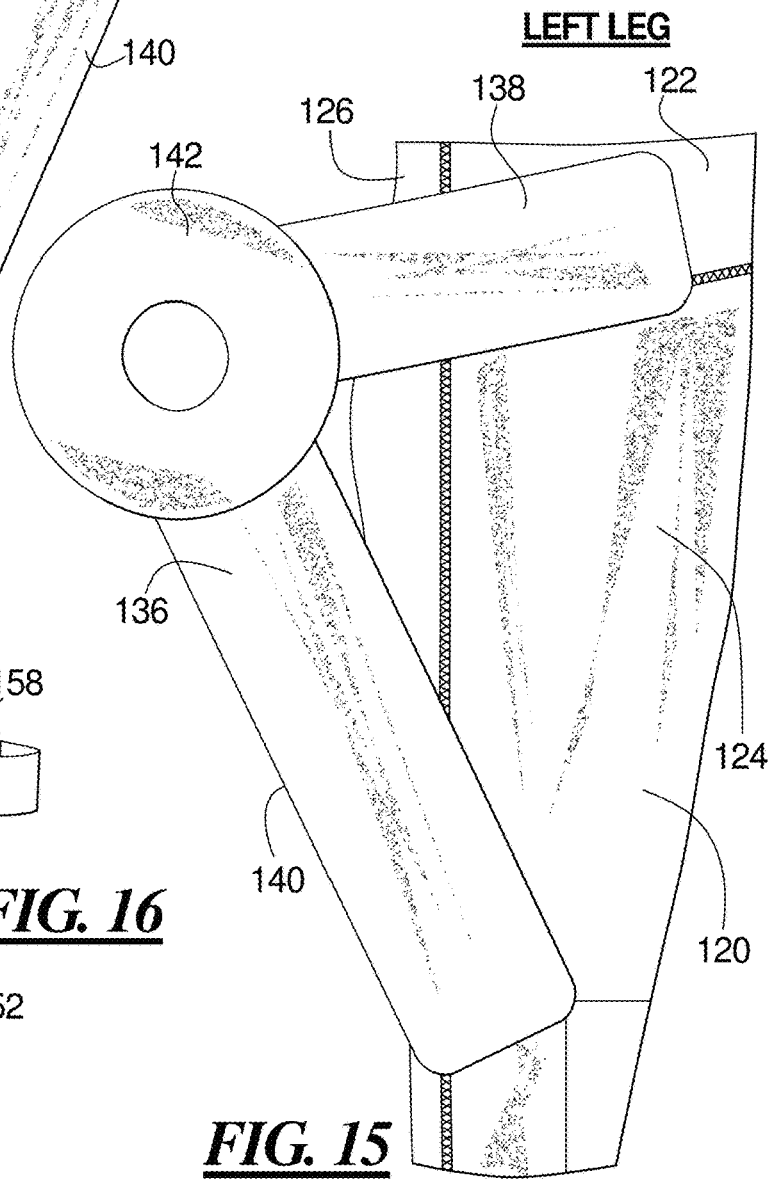

FIGS. 14 and 15 show the strap members 134 and 136 being applied to the sleeves 118 and 120 of FIGS. 10 and 11. The short and long straps 138 and 140 are fastened at their ends to the sleeves 118 and 120. For example the ends of the straps 138 and 140 are fastened to the fabric panels 124 and the top cuff 122. The connecting portion 142 is then to be wrapped around the sleeve 118 and 120 and fastened in place, such as by wrapping the strap member over the second fabric panel 126 and fastening the connecting portion to the fabric panel 124 on the other side of the strip-shaped second fabric panel 126.

Figure 16:
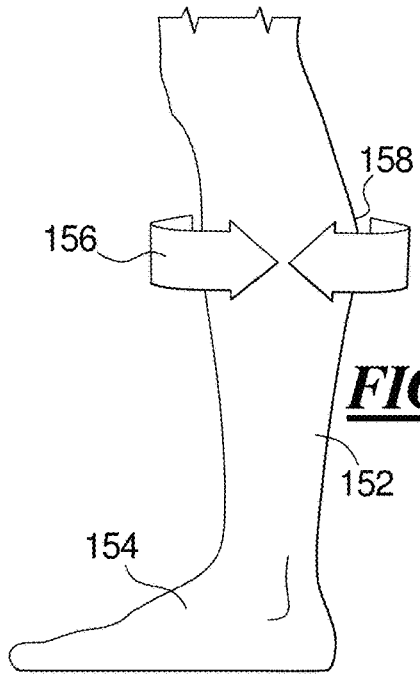
FIG. 16 is a diagram of a leg showing a measuring location for fitting a sleeve.

FIG. 16 shows a wearer's lower leg 152 and foot 154 and indicating a measurement position 156 at the largest circumference portion of the wearer's calf 158. The wearer's leg is measured for determining a correct size for the sleeve. A measurement is taken around a largest portion of the wearer's calf as shown at 156. The measurement is used to determine which size of the sleeve 118 and 120 the wearer should wear. The sleeves are provided in several sizes for different wearers.

Figure 17:
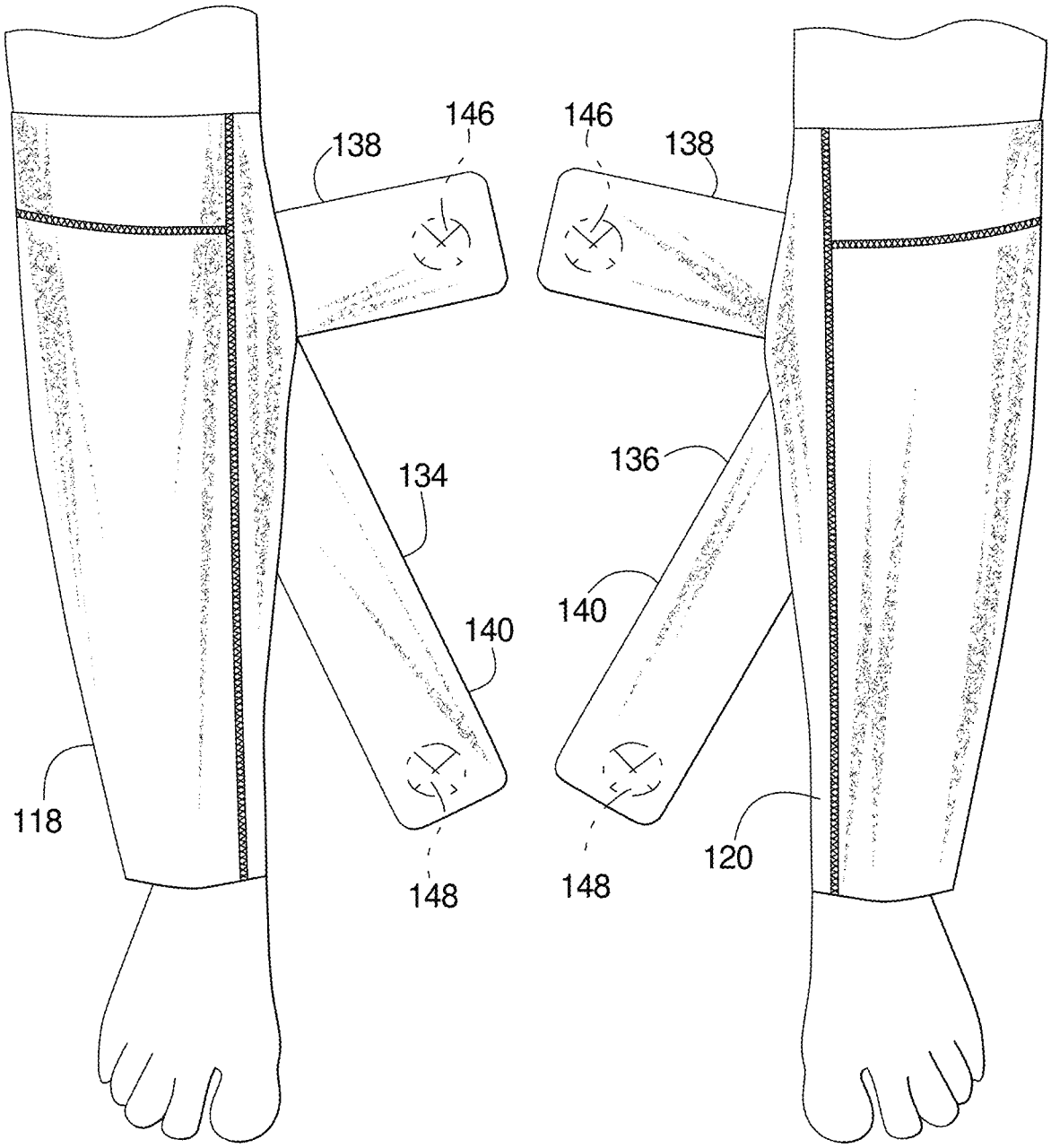
FIG. 17 is a front view of a wearer's lower legs with sleeves on the legs and showing attachment of the sleeve members starting at a connecting portion.

FIG. 17 shows another method for attaching the strap members 134 and 136 to the sleeves 118 and 120 when worn on the legs. Instead of fastening the ends of the straps 138 and 140 to each sleeve 118 and 120 and then applying tension to the straps and attaching the connecting portions 142 to the sleeves, the illustration shows that the connecting portions 142 are attached to the sleeves 118 and 120 by the fasteners 150, then tension is applied to each of the straps 138 and 140 and the straps are attached by the fasteners 146 and 148 to the sleeves 118 and 120.

Figure 18:
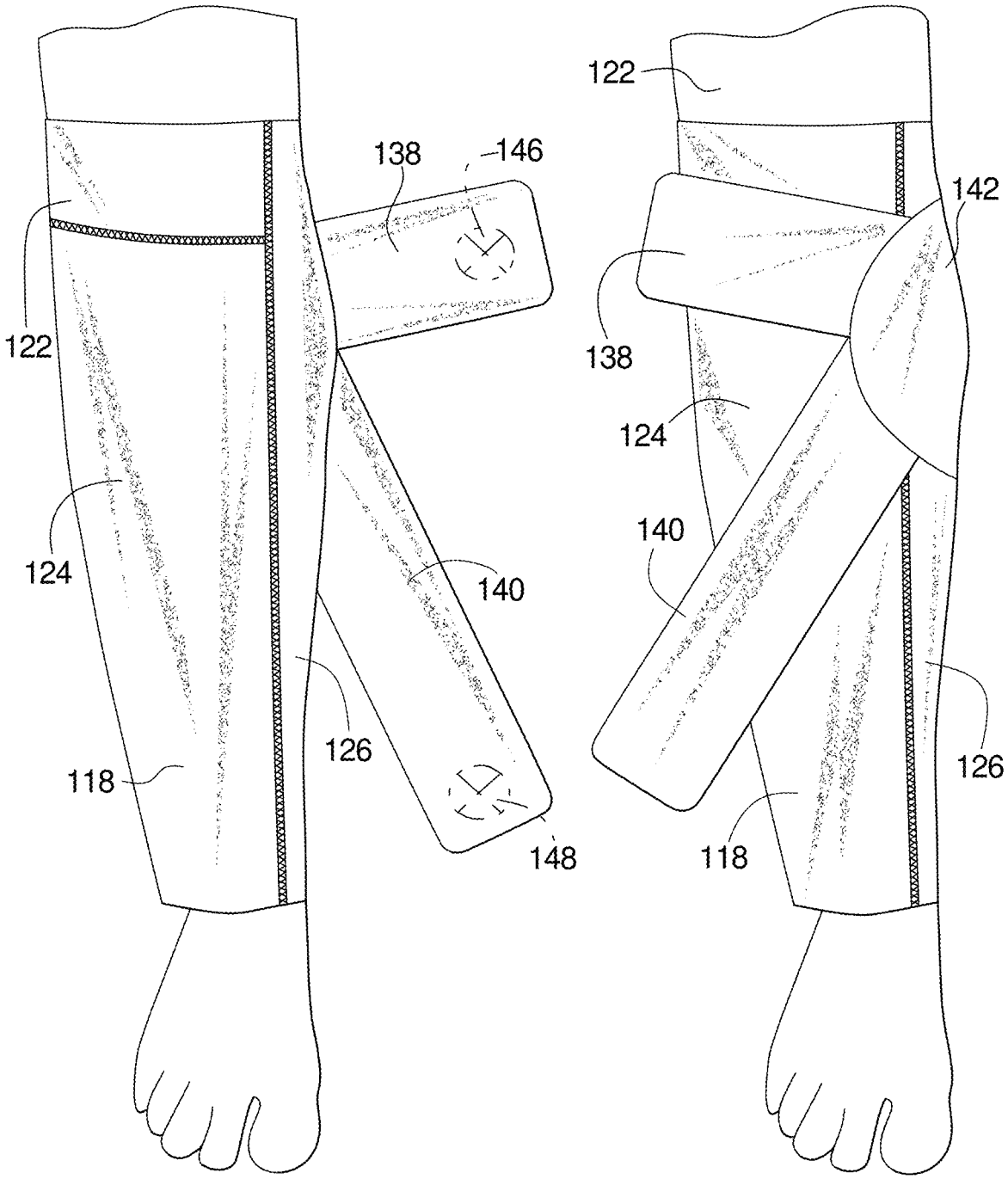
FIG. 18 is a front view of a wearer's leg showing wrapping of the strap member on the sleeve.

FIG. 18 shows wrapping the straps 138 and 140 onto the sleeve 118 while on the wearer's legs. The short strap 138 is pulled and wrapped around the upper portion of the lower leg and fastened to the sleeve 118 using the fastener 146. The direction of wrapping and tension is indicated by the arrow. The fastener 146 is fastened to the top cuff 122 and the ribbed or textured panel 124. The long strap 140 is pulled to apply a downwardly angled tension and the strap 140 is wrapped at an angle and fastened to the sleeve 118 using the fastener 148. Tension from the two straps is centered on the connecting portion 142, which is disposed at an inside top of the calf muscle group.

FIG. 19 shows a sleeve 160 for wearing on a wearer's arm. The sleeve 160 includes a thumb hole 162 that is positioned near the cuff end of the sleeve 160 on the opposite side of the user's hand 164 from the user's thumb 166 when the user's arm is in a relaxed position. A tension band 168 is provided in the sleeve 160 extending from at least the thumb hole 162 along one side of the sleeve 160. The tension band 168 extends generally linearly along one side of the sleeve 160 when the sleeve is in a relaxed and untwisted state. The sleeve may be a part of a larger garment such as a shirt or top, or may be a separate sleeve.

In FIG. 20 is an image showing application of a twisting motion to the sleeve 160 to move the thumb hole 162 toward the wearer's thumb 166. In the illustration, the user is using a finger of the other hand to engage the thumb hole 162 and exert a pulling motion as indicated by arrow 170 around the user's wrist. The tension band 168 is twisted about the wearer's arm in this motion.

FIG. 21 shows the thumb hole 162 being applied on the wearer's thumb 166 with a twist in the sleeve 160. The thumb hole 162 is being hooked onto the wearer's thumb 166.

Figure 22:
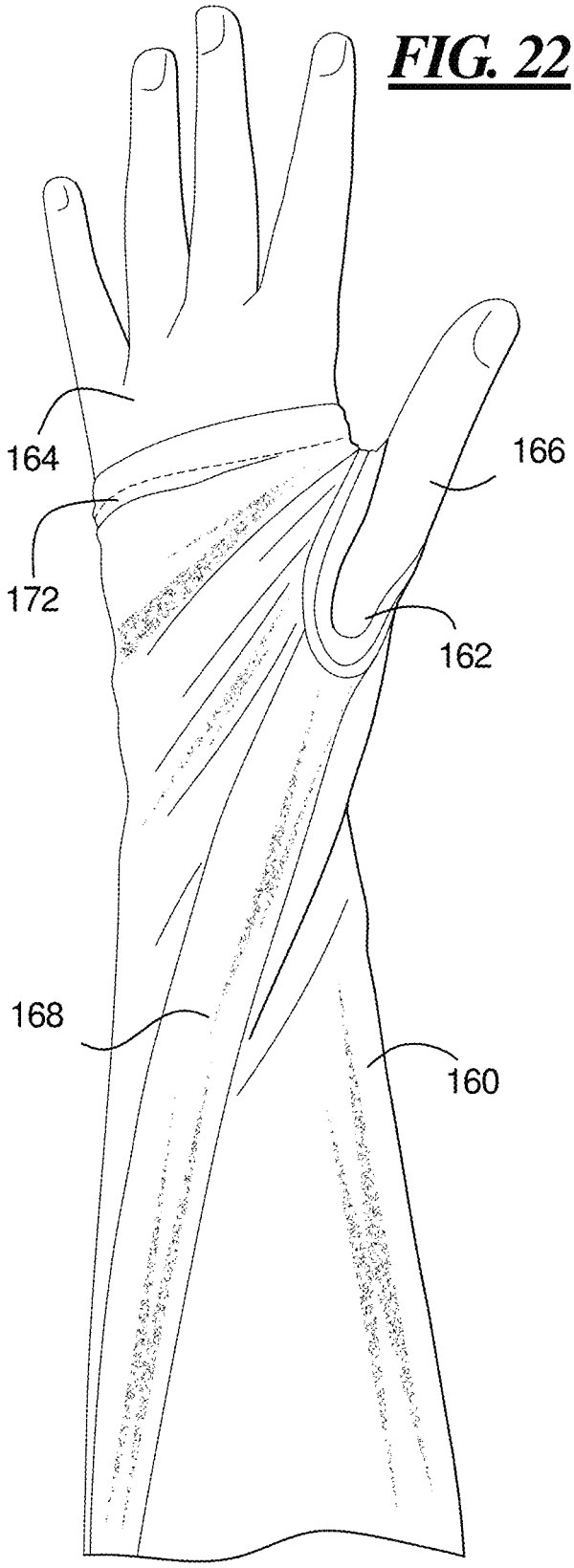
FIG. 22 is a view of the wearer's arm on which the twisting force of the sleeve is being applied.

In FIG. 22, the wearer's thumb 166 extends through the thumb hole 162 in the sleeve 160. The tension band 168 applies a twisting force to the wearer's arm as a result of the twist in the sleeve 160. The twisting force may act counter to certain muscle groups so as to relax certain muscles and remove tension from joints and other body parts. The sleeve 160 has a lower end or cuff end 172 that extends about the wearer's hand part way to the knuckles in snug engagement. The thumb hole 162 has a reinforced perimeter 174 formed by a strong webbing or other material, as an edge binding. The tension band 168 of the illustrated embodiment is sewn into or onto the sleeve 160 by two double stitched seams. The tension band 168 is formed of heavy duty webbing or other material that resists stretching.

Figure 23A:
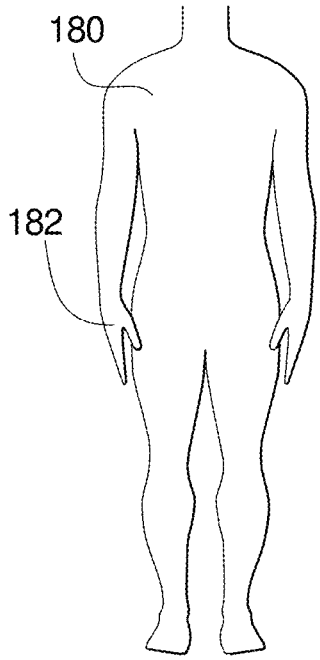
FIG. 23 are before and after views of a wearer's body showing the effect of wearing the twist sleeve.
Figure 23B:
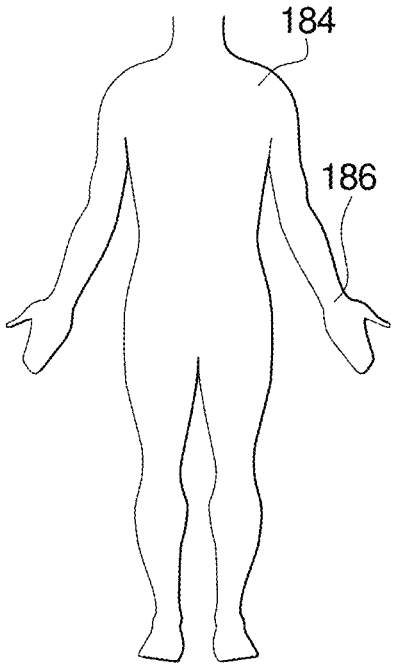

Referring to FIG. 23, a wearer's body 180 prior to wearing the twisting sleeve embodiment shows the user's hands 182 with palms toward the legs and hips. The effect of the twisting sleeve 160 is shown at 184 results in the wearer's arms and hands 186 being turned with the palms facing forward.

Figure 24:
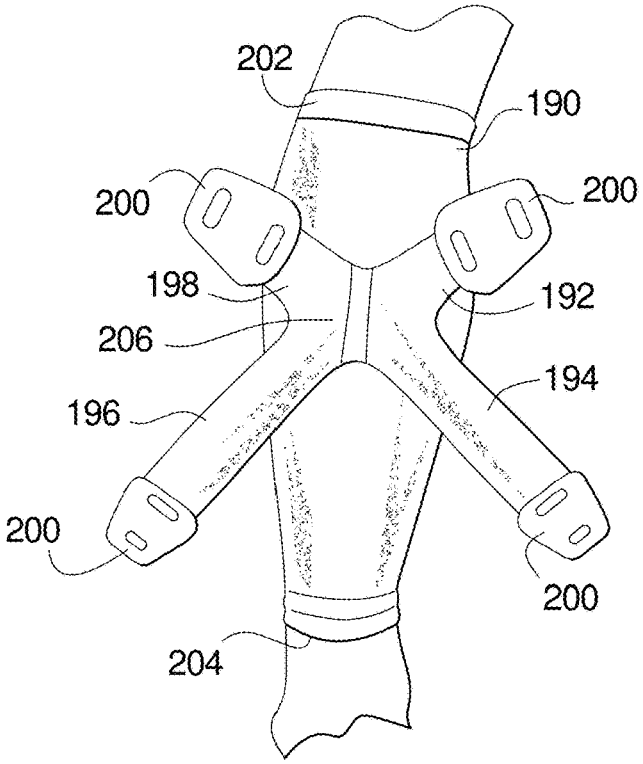
FIG. 24 is a lower leg sleeve with a four strap member assembly attached at the back of the sleeve.

FIG. 24 shows an embodiment of a sleeve 190 for wear on a lower portion of a leg. The sleeve 190 has four straps 192, 194, 196 and 198 arranged generally in a cross pattern and attached at the center to the sleeve 190 at the back of the wearer's calf. Each strap has a fastener 200 at the respective strap end. The fasteners 200 may be configured for attaching to an opposing strap, to a fastener on the sleeve 190, or to the sleeve itself. For instance, the strap 192 may be attached to the strap 196 and the strap 194 may be attached to the strap 198, to provide a crisscross application of tension forces to the user's leg. By attaching the fasteners 200 to one another and/or to the sleeve 190, tensions may be applied to the wearer's leg in the directions of the straps. The straps 192, 194, 196 and 198 of this sleeve and others may be attached to other garments worn by the wearer for transferring motion and energy to other body parts. The sleeve 190 may be formed of a stretchy material that is sized to apply compression to the lower leg of the wearer. The sleeve 190 includes a top cuff 202 and a bottom cuff 204 that may be provided with a grippy inside texture to hold the sleeve 190 in place on the wearer's leg. The straps 192, 194, 196 and 198 are attached to the sleeve 190 by a vertically extending center seam 206. A mirror image sleeve may be provided for the user's other leg.

Figure 25:
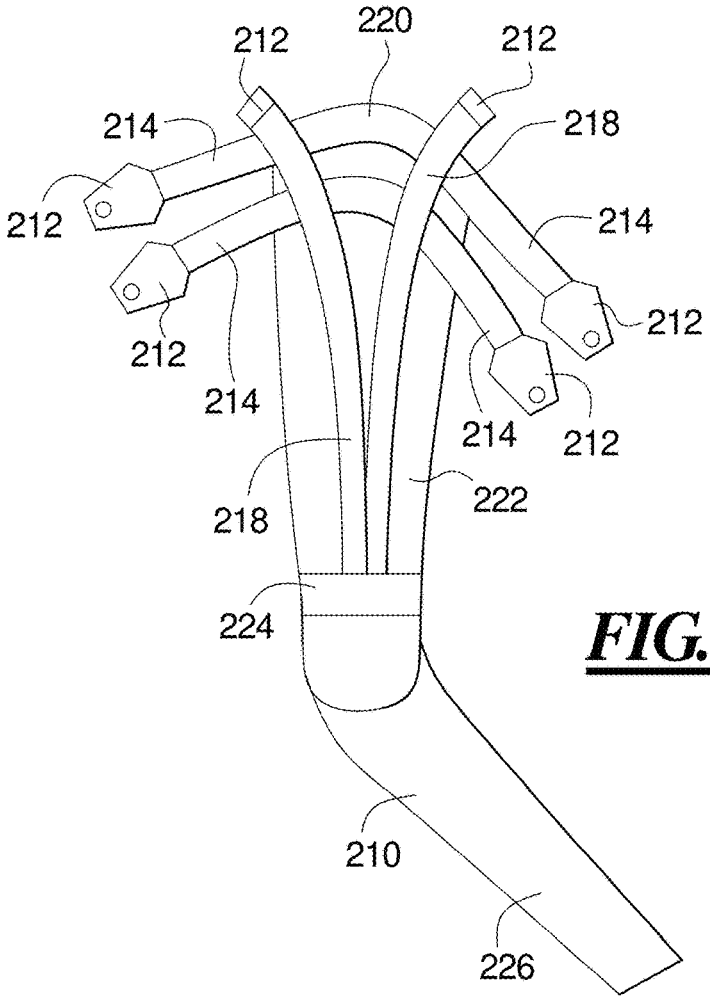
FIG. 25 is a side view of an arm sleeve for attachment to another garment to transfer arm motion to other parts of the wearer's body.

FIG. 25 shows a sleeve 210 for wear on an arm of a user. A mirror image sleeve may be provided for the user's other arm. The sleeve 210 includes provisions for attaching the sleeve 210 to the other sleeve and/or to a garment worn on the upper body of the user, such as a vest or other garment. The sleeve 210 includes fasteners 212 at ends of tension straps 214 and 218. The fasteners 212 may include buckles or Velcro fasteners, for example. The straps 214 and 218 extend laterally and vertically from a shoulder portion 220 of the sleeve 190. The shoulder portion 220 is connected to an upper arm cover 222 that includes a fabric panel that extends over an outer surface of the upper arm of the wearer. The horizontal straps 214 extend transversely across the shoulder portion 220. The vertical straps 218 extend from the shoulder portion 220 along the upper arm cover 222 to an elbow band 224. The elbow band 224 may be configured for encircling the wearer's arm above the elbow or may be disposed on the outer surface of the upper arm.

The sleeve 210 includes a lower arm portion 226. The lower arm portion 226 is formed of a fabric that is configured to fit snuggly on the lower arm or forearm of a wearer. The lower arm portion 226 is connected to the elbow band 224, which in turn is connected to the straps 218, and these are connected to the straps 214. As the wearer moves the wearer's lower arm, upper arm and/or shoulder, the arm and shoulder motion is transferred as tension and energy by the sleeve 190 to other portions of the wearer's body. The sleeve 190 may stimulate the wearer's core or other portions of the wearer's body by transferring arm energy to garments worn on other parts of the wearer's body. If the straps 214 and 218 are connected to a shirt, vest or other garment, particularly a tight fitting garment of stretch resistant materials, the arm and shoulder movements may stimulate muscles, organs or other parts of the wearer's body. The sleeve 190 may have particular utility for wheelchair users but other users may obtain therapeutic benefit from the sleeve. Motion by the wearer's arm may be transferred to other body parts by the present sleeve.

The external sleeves may be worn to improve alignment of the body. The wearable device for the arms and/or legs may apply oblique, three dimensional, compression, torque and resistance to improve body function and increase blood flow.

The present garment may include different embodiments of a modular, three dimensional compression device with a method of application composed of elastomeric materials which stimulate muscle contraction and improve limb alignment.

Certain embodiments of the invention provide a sleeve garment with a twist function that is specifically designed to provide neuromuscular stimulation using a combination of oblique three dimensional compression, torque, and angle, simultaneously applied to train body muscles for proper alignment through muscle memory.

In some embodiments, receptivity is used with tension straps that provide active oblique three dimensional compression to stimulate muscle contraction. The device also allows attachments and connectivity to other areas of the body.

In some embodiments, the device will incorporate a strip of material with increased level of tensile resistance to grip or stimulate areas of the user's body to improve muscle function and limb alignment. The strip of material can be an integral part of the device or an external, modular strap. The composition of the strip of material can be made of various textures, surface features, grip elements, slip elements, channels, layers, or other features that specifically contribute to the tensile resistance to stimulate muscle activity.

The device utilizes bands engineered in different shapes, sizes and elasticity. A variety of applications can be used on different body parts to facilitate muscle contractions. Therefore, the garment can be specifically engineered to have the desired range of pressure, tension, oblique three dimensional compression and torque.

The garment utilizes a "twist" function. Constructed with gradient sequential levels of elastomeric knits positioned on the limbs in a specific direction. A higher gradient of knit is constructed into the garment. When the sleeve is twisted by the user, the garment increases oblique three dimensional compression. This results in muscle stimulation to achieve improved alignment of the limb.

The garment may provide systemic, orthopedic and/or neurologic benefits. In addition, it may provide therapy for improving alignment, cardiovascular, symmetry and visceral functions. The present invention provides a wearable system to improve the physical and psychological health of the user.

Although other modifications and changes may be suggested by those skilled in the art, it is the intention of the inventors to embody within the patent warranted hereon all changes and modifications as reasonably and properly come within the scope of their contribution to the art.

We claim:

1. A sleeve for wear on a wearer's limb, comprising:

a lower sleeve portion formed into a cylindrical shape, the lower sleeve portion including first and second ends, the lower sleeve portion being configured for wear on a forearm of a user;

an elbow band connected to the second end of the lower sleeve portion;

an upper limb cover connected to the elbow band and extending from the elbow band, the upper limb cover having a first end connected to the elbow band and a second end opposite the first end, the second end of the upper limb cover being configured for wear on a shoulder of the user;

a first strap directly connected to the elbow band and extending from the elbow band along the upper limb cover and extending beyond the second end of the upper limb cover at a free end, the first strap including elastic material and being configured to transfer arm movement of the user to the user's torso by elastic tension along the first strap during the arm movement;

a first fastener at the free end of the first strap, the first fastener being configured for attachment to a garment worn on the torso of the user;

a second strap connected to the upper limb cover at the second end of the upper limb cover and extending transversely of the first strap, the second strap including elastic material and having first and second opposite free ends extending beyond the second end of the upper limb cover, the second strap being configured to transfer shoulder movement of the user to the user's torso by elastic tension along the second strap during shoulder movement; and second fasteners at each of the first and second free ends of the second strap, the second fasteners being configured for attachment to the garment worn on the torso of the user.

2. A sleeve as claimed in claim 1, wherein:

the first strap is configured to transfer the arm movement of the user to the user's torso by elastic tension along the first strap during the arm movement to stimulate neuro-musculature and vascular structures of the user's torso; and the second strap is configured to transfer the shoulder movement of the user to the user's torso by elastic tension along the second strap during shoulder movement to stimulate neuro-musculature and vascular structures of the lower limb of the user's torso.

* * * * *